US006862422B2

(12) United States Patent
Aoki et al.

(10) Patent No.: US 6,862,422 B2
(45) Date of Patent: Mar. 1, 2005

(54) IMAGE FORMING APPARATUS AND IMAGE FORMING METHOD HAVING PRESSING MEMBERS FOR PRESSING A BELT-LIKE MEMBER

(75) Inventors: Shinji Aoki, Shizuoka-ken (JP); Masashi Hiroki, Kanagawa-ken (JP); Takeshi Watanabe, Chiba-ken (JP); Masashi Takahashi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/364,461

(22) Filed: Feb. 12, 2003

(65) Prior Publication Data

US 2004/0156658 A1 Aug. 12, 2004

(51) Int. Cl.[7] ..... G03G 15/16

(52) U.S. Cl. ..... 399/313; 399/149; 399/303; 399/314

(58) Field of Search ..... 399/302, 312, 399/313, 310, 314, 318, 298, 299, 308, 149, 303

(56) References Cited

U.S. PATENT DOCUMENTS 3,860,857 A * 1/1975 Namiki et al. ..... 399/314
4,098,227 A * 7/1978 Thompson ..... 399/310
4,171,157 A * 10/1979 Suzuki ..... 399/313
4,401,383 A * 8/1983 Suzuki et al. ..... 399/314
4,796,047 A * 1/1989 Fowlkes et al. ..... 399/313
5,040,028 A * 8/1991 Kamimura et al. ..... 399/302
5,428,429 A * 6/1995 Fletcher ..... 399/308
5,640,661 A * 6/1997 Uchida et al. ..... 399/313
6,075,965 A * 6/2000 Tombs et al. ..... 399/308
6,134,402 A * 10/2000 Nakayama et al. ..... 399/299
6,144,824 A * 11/2000 Hashimoto et al. ..... 399/149
6,324,374 B1 * 11/2001 Sasamoto et al. ..... 399/298
6,556,802 B2 * 4/2003 Sasamoto et al. ..... 399/299
6,633,733 B2 * 10/2003 Mochimaru et al. ..... 399/302
6,708,013 B2 * 3/2004 Nomura ..... 399/299

FOREIGN PATENT DOCUMENTS

JP 03192278 A * 8/1991 ..... G03G/15/16
JP 9-134082 A 5/1997
JP 09269681 A * 10/1997 ..... G03G/15/16
JP 2002-082546 A 3/2002

* cited by examiner

*Primary Examiner*—Susan Lee
(74) *Attorney, Agent, or Firm*—Foley & Lardner LLP

(57) ABSTRACT

In a transfer unit of an image forming apparatus, an auxiliary transfer roller and a main transfer roller are provided relative to a photosensitive drum, with a transfer belt interposed. A low voltage for avoiding occurrence of a high electric field is applied to the auxiliary transfer roller, while a high transfer voltage for realizing sufficient transfer is applied to the main transfer roller.

7 Claims, 9 Drawing Sheets

| | TRANSFER EFFICIENCY [%] | DOT DUST (VISUAL EVALUATION) |
|---|---|---|
| PRIOR ART | <92 | × |
| FIRST EMBODIMENT | >95 | ○ |

※TRANSFER EFFICIENCY IS VALUE IN OPTIMAL TRANSFER DEVICE (TRANSFER ON BELT)
TONER LAYER THICKNESS : 650 [$\mu g/cm^2$]
◎ : VERY GOOD, ○ : GOOD, × : BAD

| | TRANSFER EFFICIENCY [%] | DOT DUST (VISUAL EVALUATION) |
|---|---|---|
| PRIOR ART | <92 | × |
| SECOND EMBODIMENT | >95 | ◎ |

※TRANSFER EFFICIENCY IS VALUE IN OPTIMAL TRANSFER DEVICE (TRANSFER ON BELT)
TONER LAYER THICKNESS : 650 [$\mu g/cm^2$]
◎ : VERY GOOD, ○ : GOOD, × : BAD

IMAGE FORMING APPARATUS AND IMAGE FORMING METHOD HAVING PRESSING MEMBERS FOR PRESSING A BELT-LIKE MEMBER

BACKGROUND OF THE INVENTION

The present invention relates to an image forming apparatus, such as an electronic copying machine, and an image forming method for reading an image on an original and forming an image.

A 4-series tandem type image forming apparatus having four photosensitive drums is known as a conventional color electronic copying machine.

There are two types of 4-series tandem type image forming apparatuses: a type (direct transfer type) in which toner images on photosensitive drums are directly transferred onto paper, and an intermediate transfer type in which four-color toner images are first transferred (primary transfer) onto a semi-conductive intermediate transfer body, and then batch-transferred (secondary transfer) on paper.

In the primary transfer, toner on the photosensitive drum is transferred onto the intermediate transfer body by a transfer electric field occurring between a photosensitive drum and a transfer roller. If the transfer electric field is too small, toner fails to be transferred onto the intermediate transfer body, and a great amount of toner would remain on the photosensitive drum (incomplete transfer with residual toner). On the other hand, if the transfer electric field is too large, a Paschen-discharge occurs at an air gap portion near a transfer nip portion (transfer contact portion). The Paschen-discharge causes such a phenomenon (reverse transfer) that toner once transferred on a transfer medium is attracted back to the photosensitive drum. Thus, such contradictory problems will occur due to the transfer electric field.

Further, there is such a problem that part of the toner on the photosensitive drum scatters onto the transfer medium along the transfer electric field in the gap portion in the vicinity of the transfer nip (front-side transfer, rear-side transfer), resulting in image-quality degradation. How to suppress these phenomena is a great task.

In an image forming apparatus of a photoconductor-cleanerless type in which a photosensitive drum is not equipped with a cleaner, toner (residual transfer toner) that is not transferred on a transfer medium and remains on the photosensitive drum can be recovered in a developing device, and the amount of waste toner can be reduced. Moreover, the life of the photosensitive drum can advantageously be increased.

However, there is such a serious problem that if a reverse transfer phenomenon of plural-color toners occurs at the same time, toners in the developing device would be mixed.

All of these problems occur because the transfer electric field in the vicinity of the transfer nip is not completely controlled.

BRIEF SUMMARY OF THE INVENTION

The object of an aspect of the present invention is to provide an image forming apparatus and an image forming method, which can achieve a high transfer efficiency by suppressing reverse transfer, front-side transfer and rear-side transfer due to Paschen-discharge.

In order to achieve the object, the present invention may provide an image forming apparatus which includes an image carrying body that carries a toner image, and which forms an image, comprising: a belt-like member provided to face the image carrying body; a first pressing member that presses the belt-like member on the image carrying body on an upstream side in a direction of movement of the belt-like member relative to the image carrying body; a second pressing member that presses the belt-like member on the image carrying body on a downstream side in the direction of the movement of the belt-like member relative to the image carrying body, such that the belt-like member is put in close contact with the image carrying body from a pressing portion where the first pressing member presses the image carrying body; and a voltage applying section that applies different voltages to the first and second pressing members for electrostatically transferring, when a toner image is carried on the image carrying body, the toner image onto the belt-like member or a transfer medium that is conveyed on the belt-like member.

This invention may also provide an image forming method for an image forming apparatus which includes an image carrying body that carries a toner image, and which forms an image, comprising: providing a belt-like member that faces the image carrying body; providing a plurality of pressing members, relative to the image carrying body, which press the belt-like member on the image carrying body, such that the image carrying body is put in close contact with the belt-like member only in a region between pressing portions pressed by the plurality of pressing members; and applying different voltages to the plurality of pressing members for electrostatically transferring, when a toner image is carried on the image carrying body, the toner image onto the belt-like member or a transfer medium that is conveyed on the belt-like member.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently embodiments of the invention, and together with the general description given above and the detailed description of the embodiments given below, serve to explain the principles of an aspect of the invention.

DETAILED DESCRIPTION OF THE INVENTION

Embodiments of the present invention will now be described with reference to the accompanying drawings.

Figure 1:
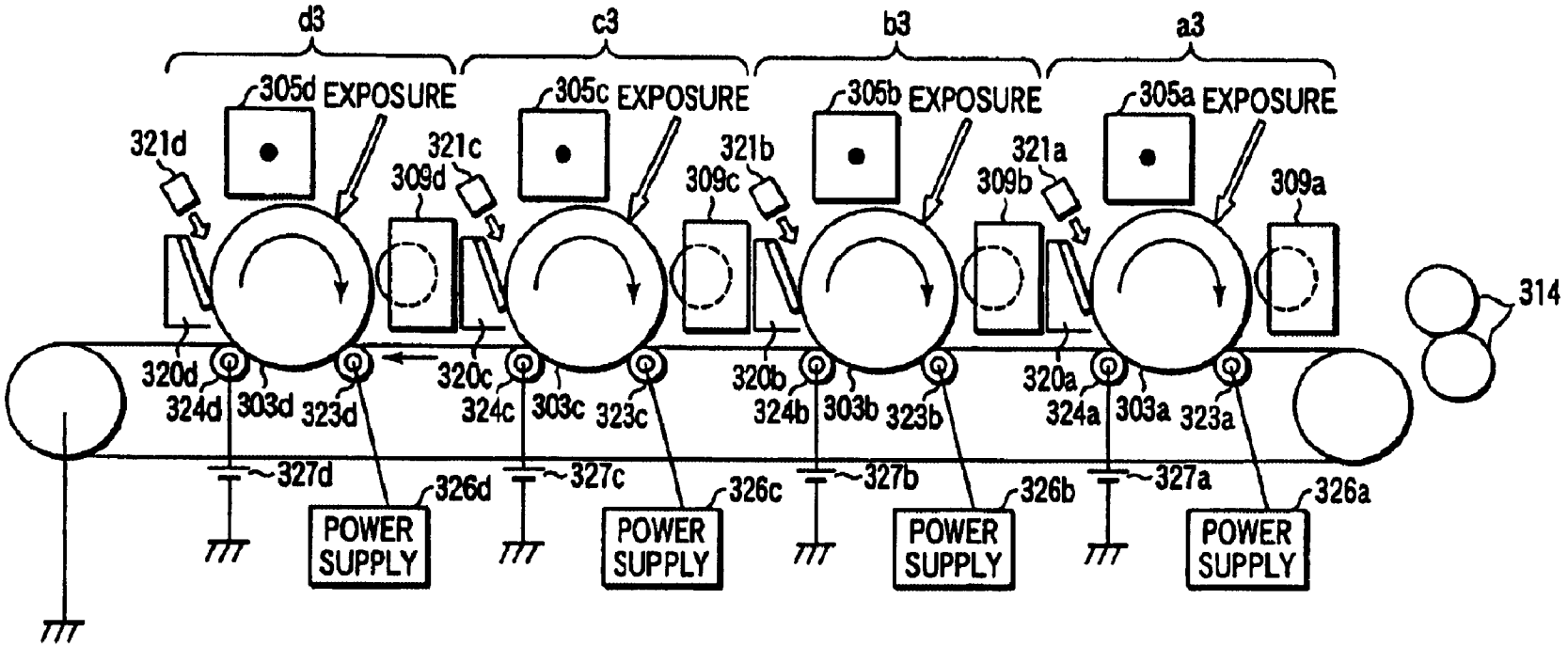
FIG. 1 is a cross-sectional view schematically showing the structure of a 4-series tandem type image forming apparatus according to a first embodiment of the image forming apparatus of the present invention.

FIG. 1 is a schematic view for describing a 4-series tandem type image forming apparatus according to a first embodiment of the image forming apparatus of the present invention. A successive color image printing operation will be described referring to the Figure.

Photosensitive drums 303*a* to 303*d* are formed of OPC (Organic Photo Conductor) and are rotatable in the direction of an arrow in FIG. 1.

An image forming process is described referring to an image forming unit a3 by way of example.

A scorotron charger 305*a* uniformly charges the photosensitive drum 303*a* with negative (−) electricity. An exposing device (not shown) is provided on the downstream side of the scorotron charger 305*a*. The charged photosensitive drum 303*a* is exposed to light in accordance with image information, and thereby an electrostatic latent image is formed on the photosensitive drum 303*a*.

A two-component developing device 309*a* containing a yellow developer (toner) is disposed on the downstream side of the developing device (not shown). The electrostatic latent image on the photosensitive drum 303*a* is reversely developed with the yellow toner, and a toner image is formed on the photosensitive drum 303*a*.

A paper sheet P, which is a transfer medium, is conveyed from a sheet cassette (not shown). The paper sheet P is fed onto a transfer belt 311 by aligning rollers 314 in accordance with a timing of toner image formation on the photosensitive drum 303*a*.

Transfer rollers 323*a* and 324*a*, as will be described later in detail, are disposed on the downstream side of the developing device 309*a*. A bias (+) of a polarity opposite to the polarity of the charged toner is applied to the transfer roller 323*a* from a power supply (V1) 326*a* and to the transfer roller 324*a* from a DC power supply (V2) 327*a*. As a result, the toner image on the photosensitive drum 303*a* is transferred onto the sheet P by a transfer electric field produced between the photosensitive drum 303*a* and the transfer rollers 323*a* and 324*a*.

At this time, part of toner (residual transfer toner), which remains on the photosensitive drum 303*a* due to incomplete transfer on the sheet P, is cleaned by a photoconductor cleaner 320*a* and sent into a waste toner box (not shown) as waste toner.

A charge remaining on the cleaned surface portion of the photosensitive drum 303*a* is erased by exposure by a charge-erase device 321*a*, following which the process of charging, exposure and development is repeated.

In synchronism with the timing of the toner image formation by the image forming unit a1, the same process is performed by the image forming units b3, c3 and d3. A magenta toner image, a cyan toner image and a black toner image formed on the photosensitive bodies 303*b* to 303*d* of image forming units b3 to d3 are successively transferred on the sheet P conveyed by the transfer belt 311.

A fixing device (not shown) for fixing the toner on the sheet P is disposed on the downstream side of the transfer belt 311. The sheet P is passed through the fixing device, and thus a fixed image is obtained.

Figures 2, 6:
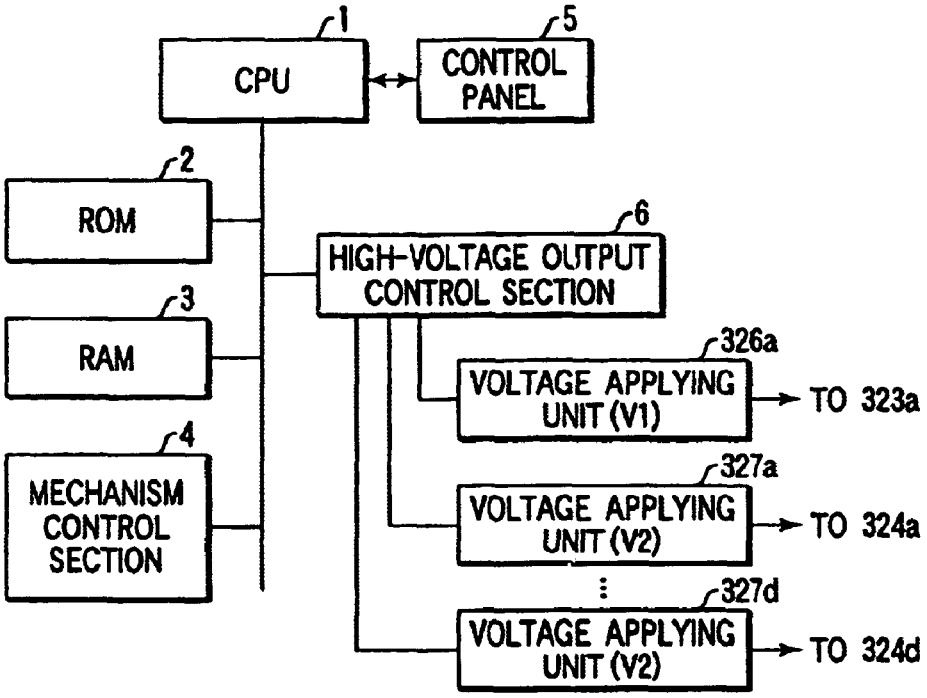
FIG. 2 is a block diagram showing a control system of the 4-series tandem type image forming apparatus.
FIG. 6 shows a relationship between transfer efficiency and image quality.

FIG. 2 shows the configuration of the control system of the 4-series tandem type image forming apparatus according to the first embodiment. Specifically, a CPU 1 that controls the entirety of the apparatus is connected to a ROM 2 that stores, e.g. predetermined numerical data or control data for operating the apparatus; a RAM 3 that temporarily stores input copying condition data, etc.; a mechanism control section 4 functioning as image forming means; a control panel 5 for inputting, e.g. various copying conditions, and a copy start signal for starting the copying operation; and a high-voltage output control section 6.

The mechanism control section 4 is associated with the respective parts of the internal structure of the 4-series tandem type image forming apparatus described with reference to FIG. 1.

The high-voltage output control section 6 is connected to a power supply (V1) 326*a* serving as a voltage applying unit, and to DC power supplies (V2) 327*a*, . . . , (V2) 327*d*, serving as voltage applying units.

The transfer unit according to the first embodiment will now be described.

Figure 3:
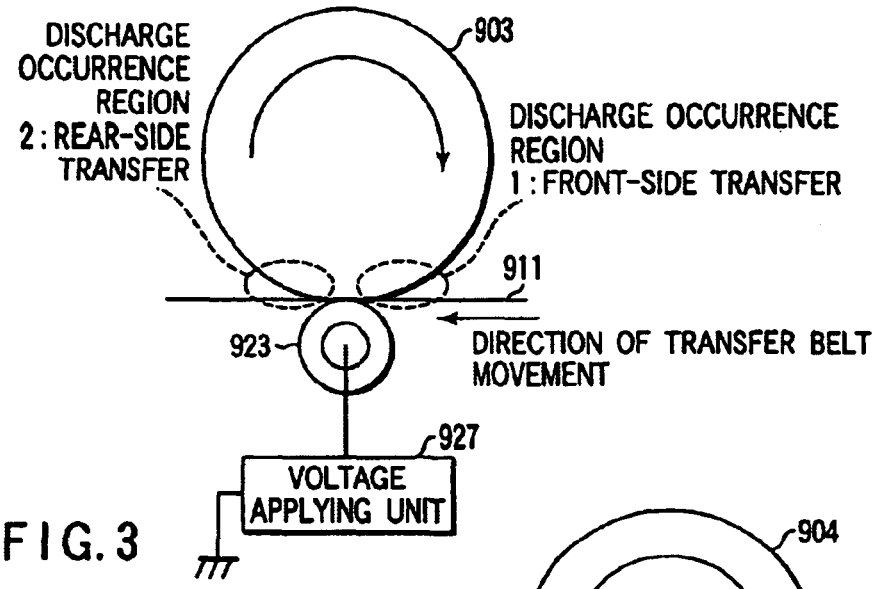
FIG. 3 shows a transfer unit using a conventional transfer roller.
Figure 4:
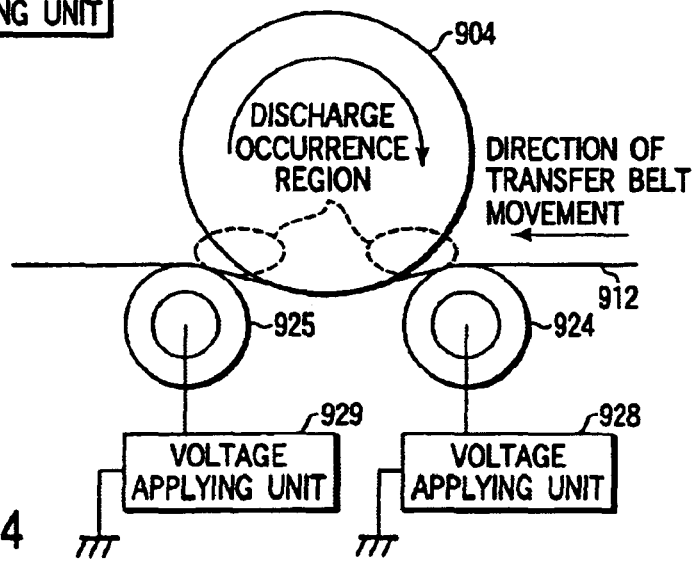
FIG. 4 shows a transfer unit using conventional transfer rollers.

FIGS. 3 and 4 show transfer units using prior-art transfer rollers.

In the prior-art transfer unit shown in FIG. 3, a high voltage (normally 1 kV to 3 kV) is applied from a voltage applying unit 927 to a transfer roller 923 in order to transfer the toner from a photosensitive drum 903 onto a transfer belt 911. Consequently, a high electric field occurs in an air gap portion between the photosensitive drum 903 and the transfer belt 911 or transfer roller 923. Hence, a Paschen-discharge, front-side transfer (discharge occurrence region 1) or rear-side transfer (discharge occurrence region 2) occurs, resulting in degradation in transfer efficiency or image quality.

In the prior-art transfer unit shown in FIG. 4, too, a Paschen-discharge occurs in an air gap portion between a photosensitive drum 904 and a transfer belt 912 or transfer roller 924, 925.

In particular, it is known that the "front-side transfer" seriously affects the image quality.

Figure 5:
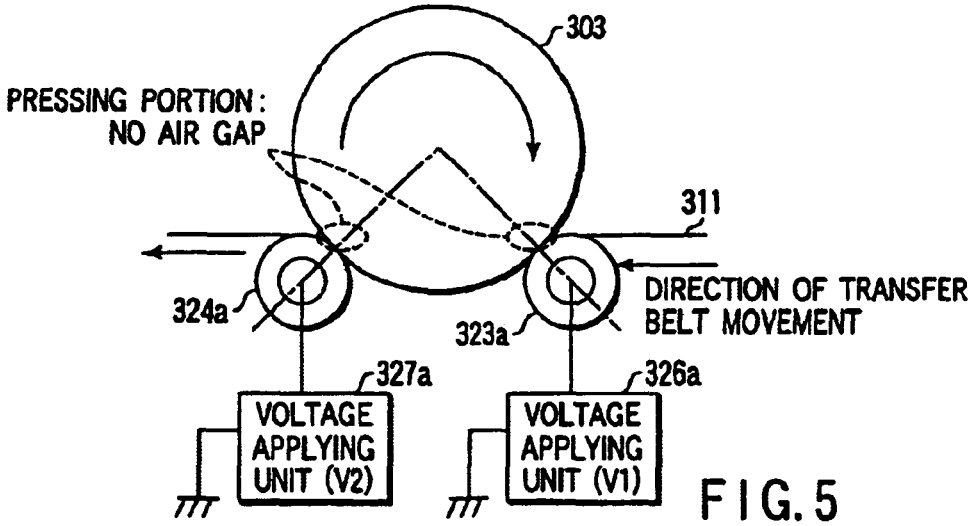
FIG. 5 shows the structure of a transfer unit in the first embodiment.

FIG. 5 shows the structure of the transfer unit using the transfer rollers 323*a* and 324*a* of the image forming unit a3 described with reference to FIG. 1. The transfer rollers 323*a* and 324*a* are arranged such that their pressing portions are present on straight lines connecting the center of the photosensitive drum 303 and the centers of the respective rollers.

The transfer unit of this embodiment achieves an electric field control for the air gap portion, in particular, on the upstream side of the transfer nip portion. Specifically, a low voltage to avoid occurrence of a high electric field is positively applied to the transfer roller 323*a* serving as an auxiliary transfer roller, while a high transfer voltage to realize sufficient transfer is applied to the transfer roller 324*a* serving as a main transfer roller. Thereby, both a high-quality image and a high transfer efficiency can be achieved.

In the structure shown in FIG. 5, the transfer roller 323*a* presses the photosensitive drum 303, with the transfer belt 311 interposed. Thus, the electric field at the air gap portion on the upstream side of the transfer nip is defined only by the voltage applied to the transfer roller 323*a,* and is not affected by the voltage to the transfer roller 324*a*. In short, the application of low voltage to the transfer roller 323*a* can suppress a Paschen-discharge or front-side transfer at the air gap portion on the upstream side of the transfer nip portion.

Further, a close contact area between the photosensitive drum 303 and transfer belt 311 is only at a region between the pressing portions of the transfer rollers 323*a* and 324*a*. Accordingly, no air gap occurs at the pressing portions of the transfer rollers 323*a* and 324*a*.

On the downstream side of the pressing portion of the transfer roller 324*a,* the photosensitive drum 303 and transfer belt 311 are separated (i.e. a gap is created) at a time when the electric field acting on the toner is dominantly acting on the transfer belt 311 side. With this structure, a high transfer efficiency is realized.

In the meantime, the presence of a close contact portion on the downstream side of the transfer roller 324*a* is effective in suppressing Paschen-discharge, but it weakens the force of the transfer electric field acting on the toner, leading to degradation in transfer efficiency.

In FIG. 5, the image forming unit a3 is described by way of example. The same applies to the image forming units b3, c3 and d3, so a description thereof is omitted.

FIG. 6 shows a relationship between transfer efficiency and image quality in cases where a prior-art transfer unit having a single transfer roller is used and the transfer unit of the present embodiment is used.

Various combinations are possible with respect to the photosensitive drum and transfer belt, the diameter and material of the transfer roller, etc. In the present embodiment, an OPC drum with ϕ60 mm was used as the photosensitive drum. A carbon-dispersed type electrically-conductive foamed urethane roller with ϕ18 mm (metal core with ϕ10 mm; the resistivity between the metal core and roller surface: about $10^{9}$ Ω/m) was used as the transfer roller. A carbon-dispersed type polyimide belt (thickness: 100 μm; volume resistance: $10^{12}$ Ω/cm) was used as the transfer belt.

It turned out that the transfer efficiency of the prior art was 92% or less whereas the transfer efficiency of the present embodiment was 95% or more. As a matter of course, in the visual evaluation of dot dust, the prior art was "bad" and the present embodiment was "good".

As has been described above, the use of the transfer unit according to the first embodiment realizes a high transfer efficiency without causing degradation in image quality.

In a case where a discharge is to be suppressed more positively, it is possible to set the application voltage to the auxiliary transfer roller to be the same polarity (e.g. −50 [V]) as the charge potential of the photosensitive drum.

The structure of the present embodiment can minimize the occurrence of residual transfer toner or reverse transfer toner and is therefore most suitable for the photoconductor-cleanerless image forming apparatus.

Figure 7:
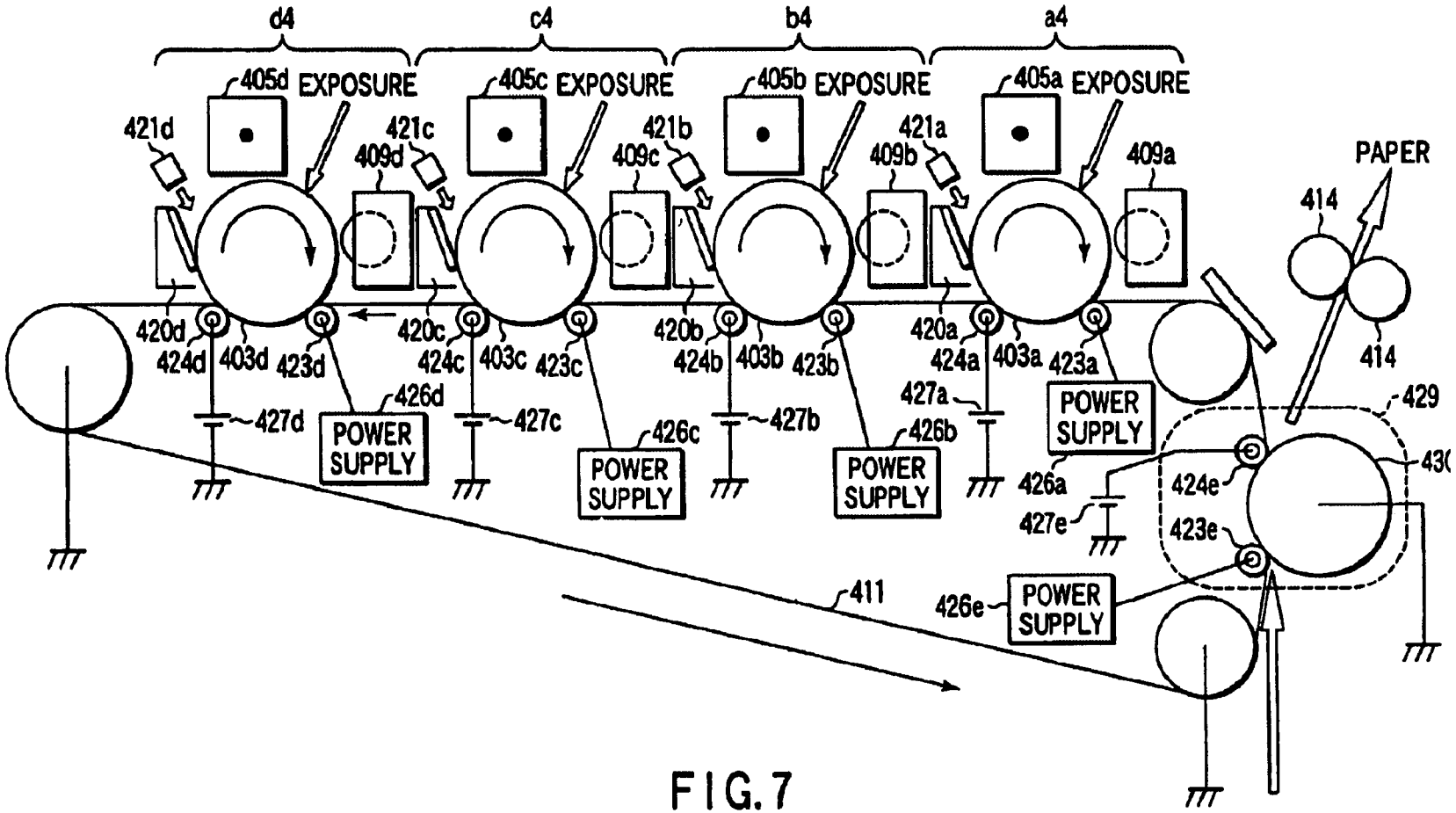
FIG. 7 shows an example of the structure of a 4-series tandem type image forming apparatus according to an intermediate transfer system, which uses the transfer unit of the first embodiment.

FIG. 7 shows an example of the structure of a 4-series tandem type image forming apparatus according to an intermediate transfer system, which uses the transfer unit of the first embodiment. The image forming units a4, b4, c4 and d4 are the same as the image forming unit a3, so a description thereof is omitted. The difference is that primary transfer is effected by an intermediate transfer section 429 and then batch-transfer is effected on the paper.

Specifically, toner images are transferred by primary transfer on an intermediate transfer body 430 in the intermediate transfer section 429, and then the toner images are batch-transferred on the paper by transfer rollers 423*e* and 424*e*.

A bias voltage (+) of a polarity opposite to the charge polarity of the toner is applied to the transfer roller 423*e* from a power supply (V1) 426*e* and to the transfer roller 424*e* from a DC power supply (V2) 427*e*. As a result, the toner images on the intermediate transfer body 430 are transferred on a paper sheet P by a transfer electric field produced between the intermediate transfer body 430, on the one hand, and the transfer rollers 423*e* and 424*e,* on the other.

Figure 8:
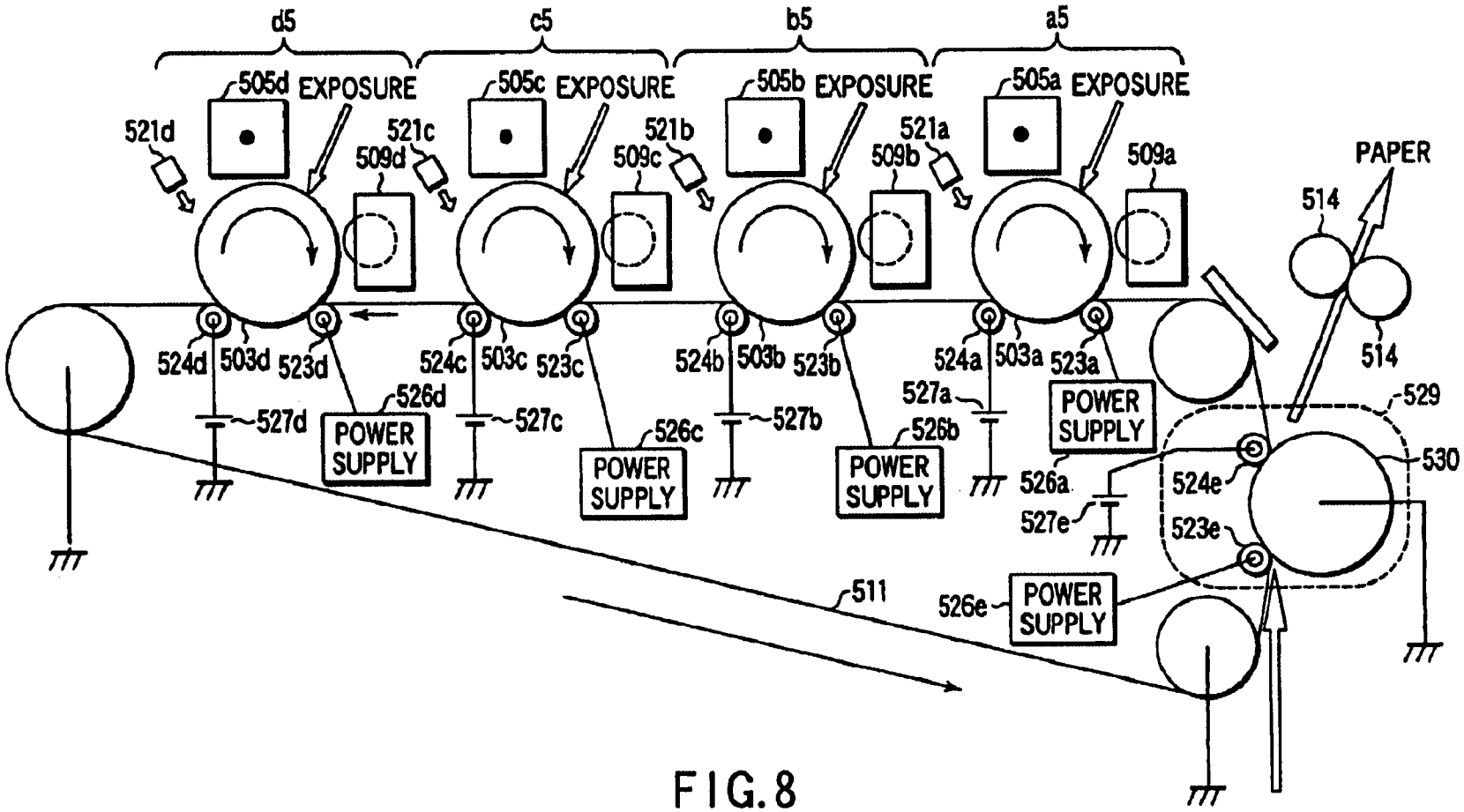
FIG. 8 shows an example of the structure of a 4-series tandem type image forming apparatus using a photoconductor-cleanerless system.

FIG. 8 shows an example of the structure of a 4-series tandem type image forming apparatus according to a photoconductor-cleanerless system. This image forming apparatus employs the intermediate transfer system, like the structure shown in FIG. 7, but the image forming units a5, b5, c5 and d5 are not provided with photoconductor cleaners.

A second embodiment of the invention will now be described.

Figure 9:
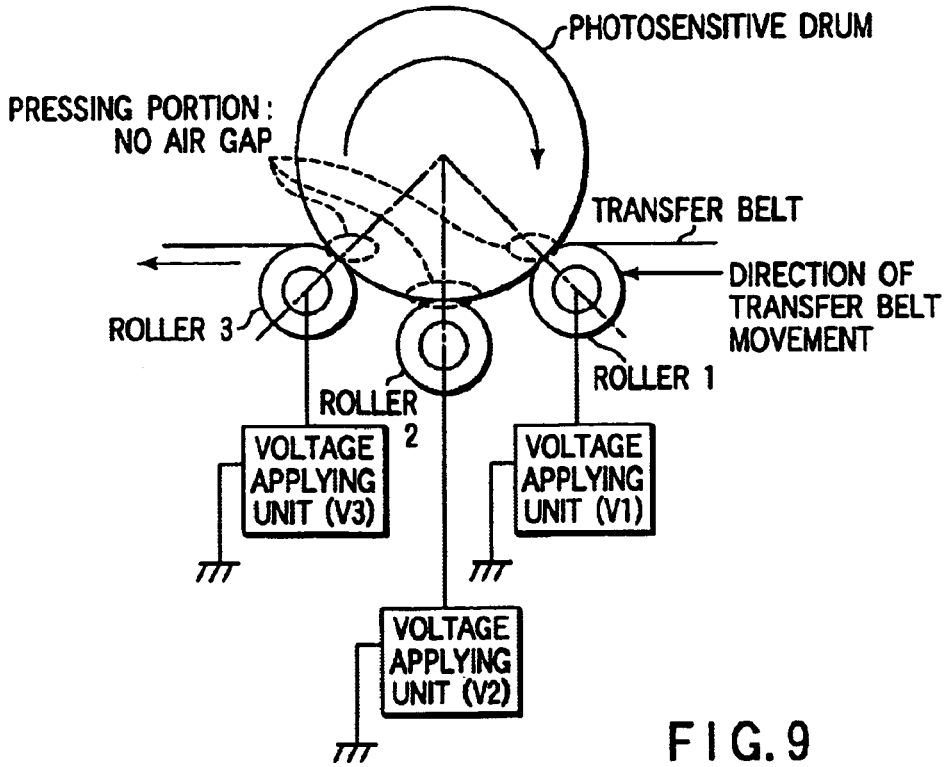
FIG. 9 shows a transfer unit according to a second embodiment of the invention.

FIG. 9 shows a transfer unit according to the second embodiment. In the transfer unit of the second embodiment, an electric field control can be effected in the vicinity of the air gap on the upstream side and downstream side of the transfer nip portion.

In the structure of the second embodiment, a low voltage for avoiding occurrence of a high electric field is positively applied to rollers 1 and 3 (auxiliary transfer rollers), while a high transfer voltage for realizing sufficient transfer is applied to a roller 2 (main transfer roller). Thereby, both a high-quality image and a high transfer efficiency can be achieved.

The rollers 1 and 3 press the photosensitive drum via the transfer belt. Hence, electric fields at air gap portions on the upstream aide and downstream side of the transfer nip portion are not affected by the voltage of the roller 2. In other words, by applying low voltages to the rollers 1 and 3, it becomes possible to suppress a Paschen-discharge, front-side transfer, and rear-side transfer at the air gap portions on the upstream side and downstream side of the transfer nip portion.

In addition, a close contact area between the photosensitive drum and transfer belt is only at a region between the pressing portions of the rollers 1 and 3. As a result, on the downstream side of the pressing portion of the roller 3, the photosensitive drum and transfer belt are separated (i.e. a gap is created) at a time when the electric field acting on the toner is dominantly acting on the transfer belt side. With this structure, a high transfer efficiency is realized. The presence of a close contact portion on the downstream side of the roller 3 is effective in suppressing Paschen-discharge, but it weakens the force of the transfer electric field acting on the toner, leading to degradation in transfer efficiency.

A voltage applying unit (V1) for the roller 1, a voltage applying unit (V2) for the roller 2 and a voltage applying unit (V3) for the roller 3 are controlled by the high-voltage output control section 6 shown in FIG. 2.

Figure 10:
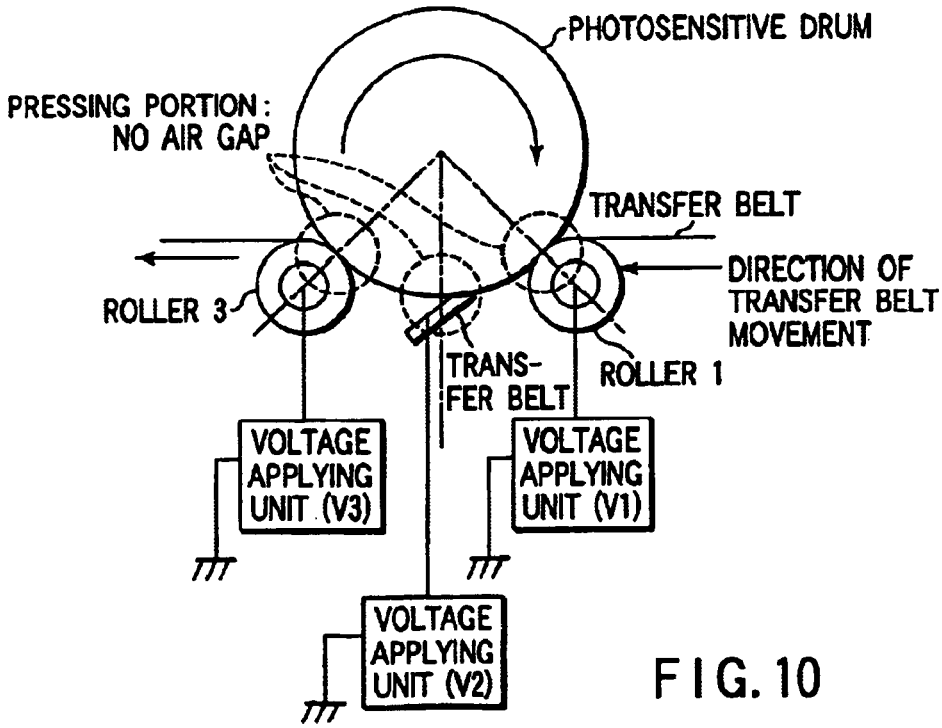
FIG. 10 shows the transfer unit according to the second embodiment of the invention.

FIG. 10 shows a structure wherein the roller 2 in FIG. 9 is replaced with a transfer blade. In the other respects, the structure and advantage are common to those of the embodiment shown in FIG. 9, so a description thereof is omitted.

Figures 11, 14:
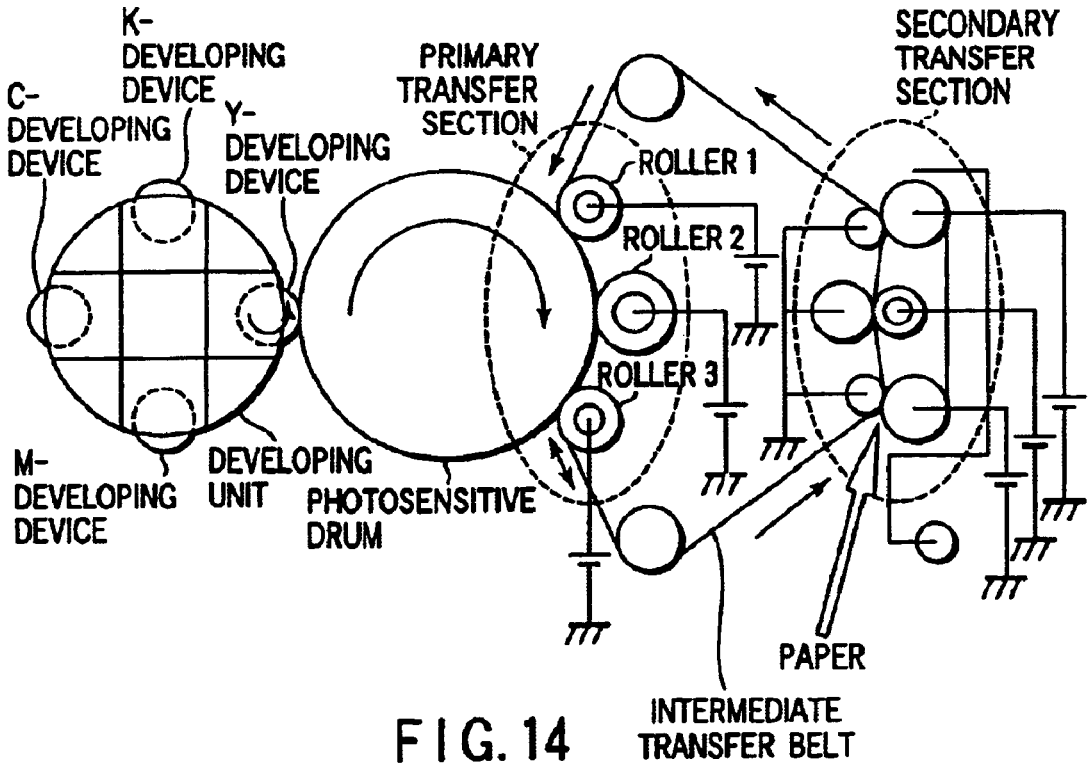
FIG. 11 shows a relationship between transfer efficiency and image quality.
FIG. 14 shows an example of the structure of a revolver-type image forming apparatus using the transfer unit of the second embodiment.

FIG. 11 shows a relationship between transfer efficiency and image quality in cases where a transfer unit having a single transfer roller is used and the transfer unit of the present embodiment is used.

Various combinations are possible with respect to the photosensitive drum and transfer belt, the diameter and material of the transfer roller, etc. In the present embodiment, an OPC drum with ϕ60 mm was used as the photosensitive drum. A carbon-dispersed type electrically-conductive foamed urethane roller with ϕ18 mm (metal core with ϕ10 mm; the resistivity between the metal core and roller surface: about $10^9$ Ω/m) was used as the transfer roller. A carbon-dispersed type polyimide belt (thickness: 100 μm; volume resistance: $10^{12}$ Ω/cm) was used as the transfer belt.

It turned out that the transfer efficiency of the prior art was 92% or less whereas the transfer efficiency of the present embodiment was 95% or more. As a matter of course, in the visual evaluation of dot dust, the prior art was "bad" and the present embodiment was "very good".

The use of the transfer unit according to the second embodiment realizes a high transfer efficiency without causing degradation in image quality. In particular, by minimizing an application voltage to the roller 1 on the upstream side in the direction of movement of the transfer medium, it becomes possible to suppress front-side transfer that seriously affects the image quality, and to enhance reproducibility of dots, etc. Thus, in the second embodiment, the application voltage to the roller 1 is set at a lowest value, thereby to more positively suppress Paschen-discharge or front-side transfer at the front side of the transfer nip portion.

In order to more positively suppress discharge, it is possible to set the application voltage to the roller 1 to be the same polarity (e.g. −50 [V]) as the charge potential of the photosensitive body.

A rear-side transfer occurring on the downstream side of the transfer nip portion does not cause image-quality degradation as much as the front-side transfer. Accordingly, the degree of freedom for the set voltage of the roller 3 is greater than that for the set voltage of the roller 1, but it is necessary to produce an electric field by which toner is attracted to the transfer medium. It is thus necessary to set the polarity of the application voltage to the roller 3 to be opposite to the charge polarity of toner, and to set the application voltage to the roller 3 at a value higher than the background voltage of the photosensitive drum (e.g. +900 V).

The structure of the second embodiment can minimize the occurrence of residual transfer toner or reverse transfer toner and is therefore most suitable for the photoconductor-cleanerless image forming apparatus.

The number of the pressing portions may be set at four or more.

Figure 12:
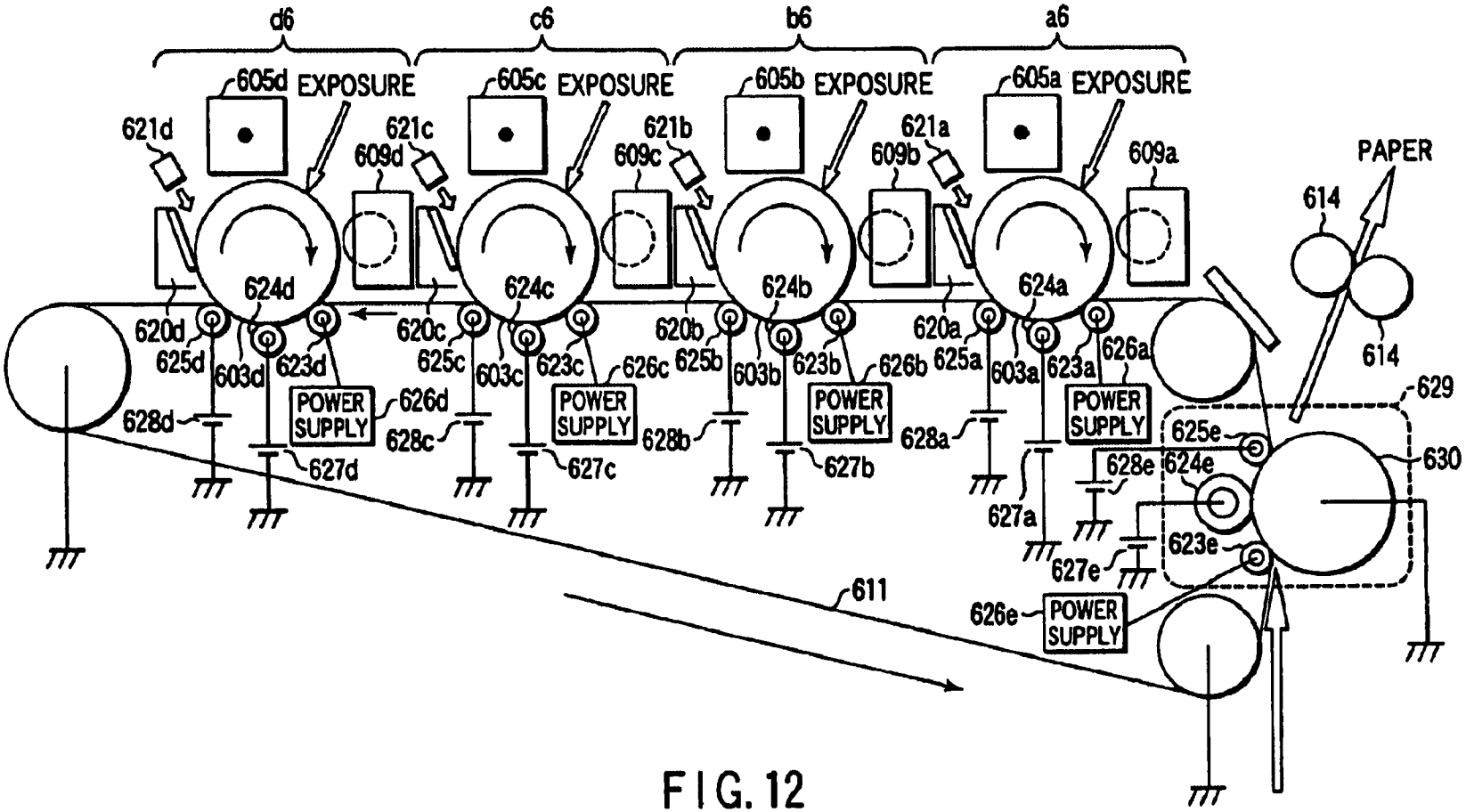
FIG. 12 shows an example of the structure of a 4-series tandem type image forming apparatus according to an intermediate transfer system, which uses the transfer unit of the second embodiment.

FIG. 12 shows the structure of a 4-series tandem type image forming apparatus according to an intermediate transfer system, which uses the transfer unit of the second embodiment. An image forming unit a6 comprises a photosensitive drum 603*a,* a scorotron charger 603*a,* a two-component developing device 609*a,* transfer rollers 623*a,* 624*a* and 625*a,* a photosensitive-body cleaner 620*a,* and a charge erase device 621*a.* A power supply (V1) 326*a* is connected to the transfer roller 623*a.* A DC power supply (V2) 627*a* is connected to the transfer roller 624*a,* and a DC power supply (V3) 628*a* is connected to the transfer roller 625*a.*

Image forming units b6, c6 and d6 have the same structure as the image forming unit a6, so a description thereof is omitted.

Primary transfer is effected by an intermediate transfer section 629 and then batch-transfer is effected on the paper. Specifically, toner images are transferred by primary transfer on an intermediate transfer body 630 in the intermediate transfer section 629, and then the toner images are batch-transferred on the paper by transfer rollers 623*e,* 624*e* and 625*e.*

Figure 13:
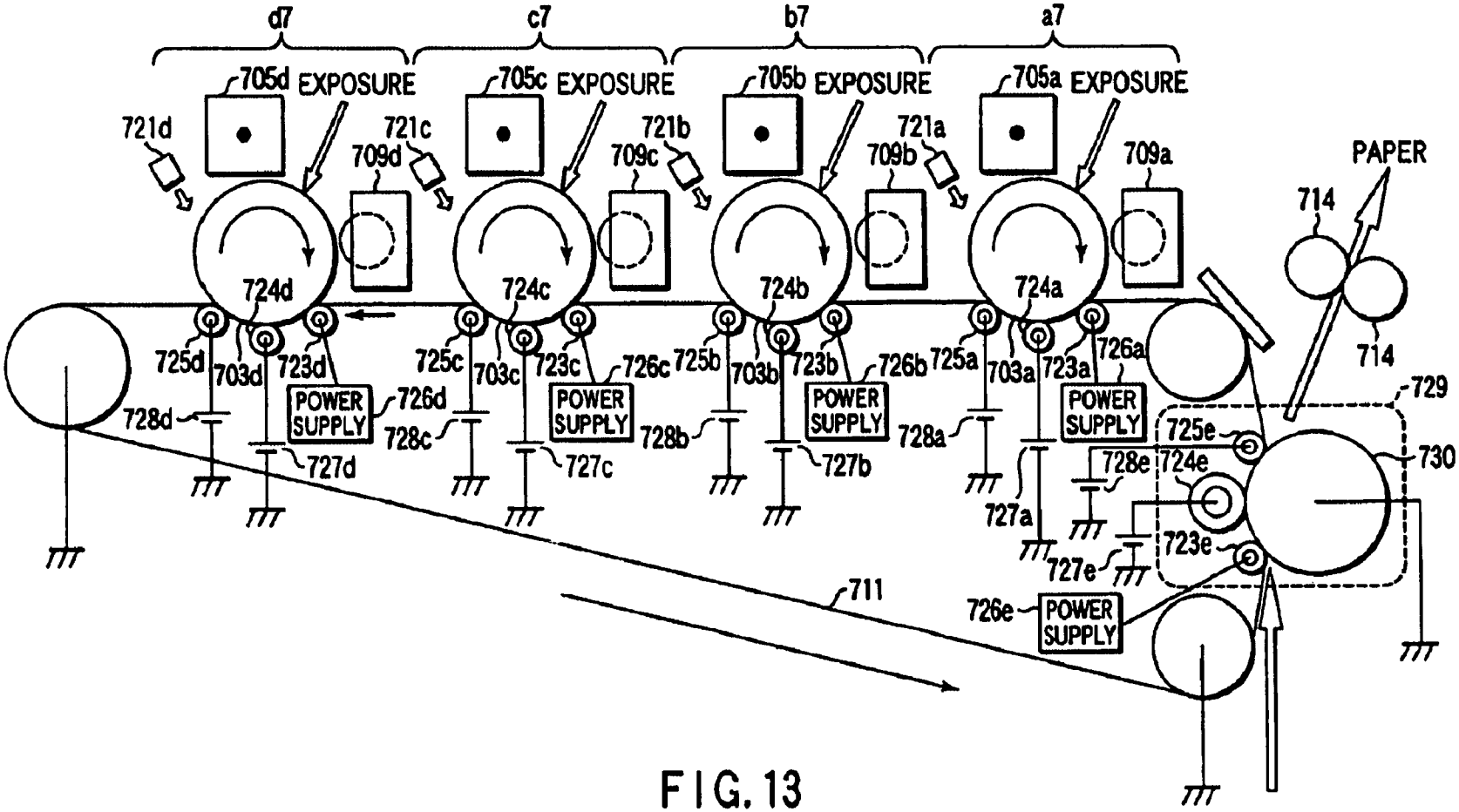
FIG. 13 shows an example of the structure of a 4-series tandem type image forming apparatus using a photoconductor-cleanerless system.

FIG. 13 shows the structure of a 4-series tandem type image forming apparatus according to a photoconductor-cleanerless system. This image forming apparatus employs the intermediate transfer system, like the structure shown in FIG. 12, but the image forming units a7, b7, c7 and d7 are not provided with photoconductor cleaners.

FIG. 14 shows the structure of a revolver-type image forming apparatus using the transfer unit of the second embodiment. The transfer unit of the second embodiment is applicable to a revolver-type apparatus. In FIG. 14, rollers 1, 2 and 3, which are main and auxiliary transfer rollers, are disposed relative to the photosensitive drum, and transfer is effected as described above.

As has been described above, according to the embodiments of the present invention, both a high transfer efficiency and a high image quality can be achieved without causing reverse transfer, front-side transfer, or rear-side transfer.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which includes an image carrying body that carries a toner image, and which forms an image, comprising:

a belt-like member provided to face the image carrying body;

a first pressing member that presses the belt-like member on the image carrying body on an upstream side in a direction of movement of the belt-like member relative to the image carrying body;

a second pressing member that presses the belt-like member on the image carrying body on a downstream side in the direction of the movement of the belt-like member relative to the image carrying body, such that the belt-like member is put in close contact with the image carrying body from a pressing portion where the first pressing member presses the image carrying body; and a voltage applying section that applies different voltages to the first and second pressing members for electrostatically transferring, when a toner image is carried on the image carrying body, the toner image onto the belt-like member or a transfer medium that is conveyed on the belt-like member, wherein the voltage applying section sets a polarity of the voltage applied to the first pressing member to be the same as a polarity of the toner carried on the image carrying body.

2. An image forming apparatus which includes an image carrying body that carries a toner image, and which forms an image, comprising:

a belt-like member provided to face the image carrying body;

a first pressing member that presses the belt-like member on the image carrying body on an upstream side in a direction of movement of the belt-like member relative to the image carrying body;

a second pressing member that presses the belt-like member on the image carrying body on a downstream side of the first pressing member in the direction of the movement of the belt-like member, such that the belt-like member is put in close contact with the image carrying body from a pressing portion where the first pressing member presses the image carrying body;

a third pressing member that presses the belt-like member on the image carrying body on a downstream side of the second pressing member in the direction of the movement of the belt-like member, such that the belt-like member is put in close contact with the image carrying body from a pressing portion where the second pressing member presses the image carrying body; and a voltage applying section that applies different voltages to the first, second and third pressing members for electrostatically transferring, when a toner image is carried on the image carrying body, the toner image onto the belt-like member or a transfer medium that is conveyed on the belt-like member.

3. The image forming apparatus according to claim 2, wherein each of the first, second and third pressing members has a roller shape.

4. The image forming apparatus according to claim 2, wherein the first and third pressing members are transfer rollers, and the second pressing member is a transfer blade.

5. The image forming apparatus according to claim 2, wherein the voltage applying section meets a condition of V2>V3>V1 , where V1 is the voltage applied to the first pressing member, V2 is the voltage applied to the second pressing member, and V3 is the voltage applied to the third pressing member.

6. The image forming apparatus according to claim 2, wherein the voltage applying section sets a polarity of the voltage applied to the first pressing member to be the same as a polarity of the voltage applied to the toner carried on the image carrying body.

7. The image forming apparatus according to claim 2, wherein the image forming apparatus does not have a cleaner for removing toner carried on the image carrying body.

* * * * *